US011693349B2

(12) United States Patent
Uchida

(10) Patent No.: US 11,693,349 B2
(45) Date of Patent: Jul. 4, 2023

(54) IMAGE FORMING APPARATUS WHICH CONTROLS FAN SPEED OF FIRST AND SECOND AIR OUTLET PORTS FACING SHEET

(71) Applicant: CANON KABUSHIKI KAISHA, Tokyo (JP)

(72) Inventor: Yuki Uchida, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/696,138

(22) Filed: Mar. 16, 2022

(65) Prior Publication Data

US 2022/0317622 A1 Oct. 6, 2022

(30) Foreign Application Priority Data

Apr. 1, 2021 (JP) ..... JP2021-062670

(51) Int. Cl.

*G03G 15/00* (2006.01)
*G03G 21/00* (2006.01)
*G03G 21/20* (2006.01)
*G03G 15/20* (2006.01)

(52) U.S. Cl.

CPC ..... *G03G 15/6573* (2013.01); *G03G 21/206* (2013.01); *G03G 15/2017* (2013.01); *G03G 15/5008* (2013.01); *G03G 2215/00421* (2013.01); *G03G 2221/1645* (2013.01)

(58) Field of Classification Search

CPC ..... G03G 15/5029; G03G 15/6573; G03G 21/206; G03G 2215/00421; G03G 2215/00426; G03G 2215/00751; G03G 2215/00586; G03G 2221/1645

USPC ..... 399/92, 341, 405

See application file for complete search history.

(56) References Cited

U.S. PATENT DOCUMENTS 6,259,871 B1 * 7/2001 Rider ..... B65H 29/00 399/92
2007/0059024 A1 * 3/2007 Kitayama ..... G03G 15/2039 399/92
2009/0110454 A1 * 4/2009 Satomi ..... G03G 15/6573 399/341
2009/0175643 A1 * 7/2009 Maynard ..... B32B 38/10 399/92
2009/0252525 A1 * 10/2009 Kojima ..... G03G 15/6573 399/92

(Continued)

FOREIGN PATENT DOCUMENTS

JP 2007058077 A * 3/2007
JP 2014-139643 A 7/2014

*Primary Examiner* — Robert B Beatty
(74) *Attorney, Agent, or Firm* — Venable LLP

(57) ABSTRACT

An image forming apparatus includes a single fan, a first air outlet port disposed so as to supply air sent from the fan to an image surface of the sheet, a second air outlet port disposed so as to supply the air sent from the fan to a surface opposite to the image surface of the sheet, and a control unit configured to control the fan. The control unit includes a first mode of controlling a rotational speed of the fan at a first rotational speed in a case where the sheet is not present in a position facing the first air outlet port and control the rotational speed of the fan at a second rotational speed lower than the first rotational speed in a case where the sheet is present in the position facing the first air outlet port.

18 Claims, 10 Drawing Sheets

(56) References Cited

U.S. PATENT DOCUMENTS

| | | | | |
|---|---|---|---|---|
| 2011/0081176 | A1* | 4/2011 | Masuda | B65H 29/125 399/341 |
| 2012/0201564 | A1* | 8/2012 | Masuda | G03G 15/657 399/92 |
| 2012/0268751 | A1* | 10/2012 | Ishida | G03G 15/6573 358/1.1 |
| 2020/0387102 | A1* | 12/2020 | Midorikawa | G03G 15/6552 |

* cited by examiner

FIG.6

| | GRAMMAGE [g/m$^2$] | |
|---|---|---|
| | LESS THAN 106 | EQUAL TO OR MORE THAN 106 |
| SIMPLEX PRINTING | SECOND MODE | FIRST MODE |
| DUPLEX PRINTING | SECOND MODE | SECOND MODE |

FIG.10

| CASE OF FAN TURNED ON | | GRAMMAGE [g/m²] | |
|---|---|---|---|
| | | LESS THAN 106 | EQUAL TO OR MORE THAN 106 |
| SIMPLEX PRINTING | DEW CONDENSATION | GOOD | GOOD |
| | ADHESION OF DISCHARGED SHEET | GOOD | GOOD |
| | CURL | GOOD | NO-GOOD |
| DUPLEX PRINTING | DEW CONDENSATION | GOOD | GOOD |
| | ADHESION OF DISCHARGED SHEET | GOOD | GOOD |
| | CURL | GOOD | GOOD |

| CASE OF FAN TURNED OFF |
|---|
| NO-GOOD |
| GOOD |
| GOOD |

IMAGE FORMING APPARATUS WHICH CONTROLS FAN SPEED OF FIRST AND SECOND AIR OUTLET PORTS FACING SHEET

BACKGROUND OF THE INVENTION

Field of the Invention

This disclosure relates to an image forming apparatus forming an image on a sheet.

Description of the Related Art

By Japanese Patent Laid-Open No. 2014-139643, an image forming apparatus including a fixing unit fixing a toner image transferred onto a sheet on the sheet, and first and second axial flow fans applying air to the sheet passed through the fixing unit is suggested. The first axial flow fan applies the air to an image surface of the sheet, and the second axial flow fan applies the air to a non-image surface of the sheet.

In the image forming apparatus of Japanese Patent Laid-Open No. 2014-139643, the first axial flow fan is not driven in a simplex printing mode, and is continuously driven in a duplex printing mode. However, in a case where the simplex printing mode is performed without driving the first axial flow fan, there is a possibility that a toner image on the image surface is not fully solidified and causes the adhesion of a discharged sheet by which the sheets stacked on a sheet discharge tray adhere to each other. Further, in a case where a single fan is disposed in a configuration, since, when the fan is stopped, it is not possible to apply the air to both sides of the image and non-image surfaces of the sheet, it is possible that, in addition to the adhesion of the discharged sheet, troubles such as a curl and dew condensation occur. If the adhesion of the discharged sheet, the curl, and the dew condensation occur, the quality of deliverables is degraded.

SUMMARY OF THE INVENTION

According to a first aspect of the present invention, an image forming apparatus includes a transfer unit configured to transfer a toner image onto a sheet, a fixing unit configured to fix the toner image transferred by the transfer unit on the sheet, a discharge unit configured to discharge the sheet on which the toner image has been fixed, a conveyance path through which the sheet conveyed from the fixing unit to the discharge unit passes, a single fan configured to rotate so as to send air, a first air outlet port disposed on the conveyance path, and disposed so as to supply the air sent from the fan to an image surface of the sheet passing through the conveyance path, the image surface being a surface on which the toner image has been fixed, a second air outlet port disposed on the conveyance path, and disposed so as to supply the air sent from the fan to a surface opposite to the image surface of the sheet passing through the conveyance path, and a control unit configured to control the fan. The control unit includes a first mode of controlling a rotational speed of the fan at a first rotational speed in a case where the sheet is not present in a position facing the first air outlet port and control the rotational speed of the fan at a second rotational speed lower than the first rotational speed in a case where the sheet is present in the position facing the first air outlet port.

According to a second aspect of the present invention, an image forming apparatus includes a transfer unit configured to transfer a toner image onto a sheet, a fixing unit configured to fix the toner image transferred by the transfer unit on the sheet, a discharge unit configured to discharge the sheet on which the toner image has been fixed, a conveyance path through which the sheet conveyed from the fixing unit to the discharge unit passes, a single fan configured to rotate so as to send air, a first air outlet port disposed on the conveyance path, and disposed so as to supply the air sent from the fan to an image surface of the sheet passing through the conveyance path, the image surface being a surface on which the toner image has been fixed, a second air outlet port disposed on the conveyance path, and disposed so as to supply the air sent from the fan to a surface opposite to the image surface of the sheet passing through the conveyance path, and a control unit configured to control the fan. The control unit includes a first mode of controlling a rotational speed of the fan at a first rotational speed in a case where a printing area of the sheet is not present in a position facing the first air outlet port and controlling the rotational speed of the fan at a second rotational speed lower than the first rotational speed in a case where the printing area of the sheet is present in the position facing the first air outlet port.

Further features of the present invention will become apparent from the following description of exemplary embodiments with reference to the attached drawings.

BRIEF DESCRIPTION OF THE DRAWINGS

FIG. 6 is a table showing a drive control method of the fan.

FIG. 10 is a table showing effects on dew condensation, adhesion of discharged sheet, and a curl.

DESCRIPTION OF THE EMBODIMENTS

General Arrangement

Figure 1:
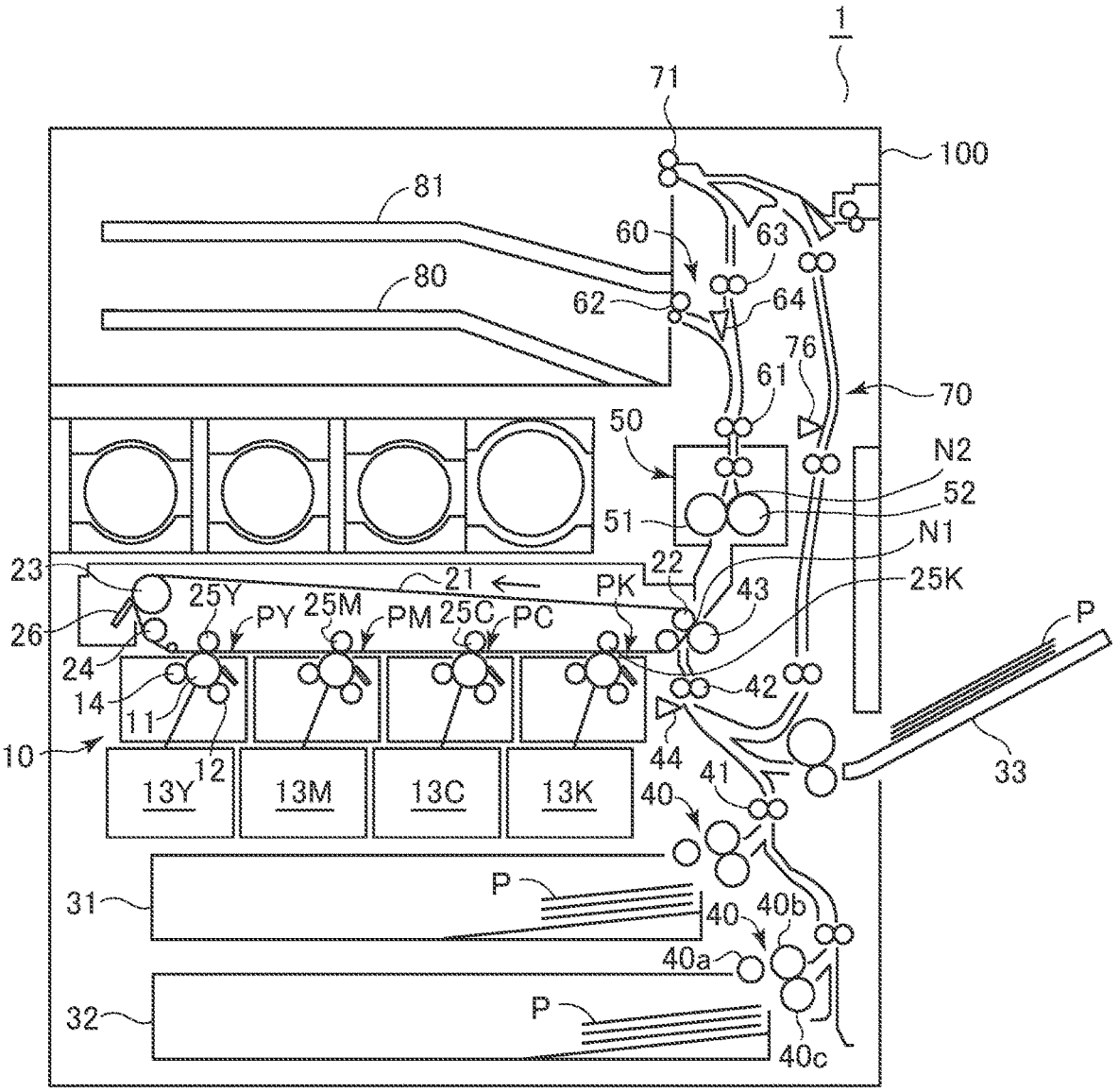
FIG. 1 is a schematic diagram showing an entire printer according to this embodiment.

A printer 1, serving as an image forming apparatus according to this embodiment, is a laser beam printer of an electrophotographic system. As shown in FIG. 1, the printer 1 includes an image forming unit 10, cassettes 31 and 32 detachably disposed in two stages in an apparatus body 100 of the printer 1, a feed unit 40, a fixing unit 50, and a discharge conveyance unit 60. Further, the printer 1 includes sheet discharge trays 80 and 81, a duplex conveyance unit 70, and a manual feed tray 33 supported by the apparatus body 100 in an openable manner.

When a command for image formation is output to the printer 1, an image forming process by the image forming unit 10 is started based on image information input from an external computer and the like coupled to the printer 1. The image forming unit 10 includes laser scanners 13Y, 13M, 13C, and 13K and four process cartridges PY, PM, PC, and PK forming images of four colors, namely yellow (Y), magenta (M), cyan (C), and black (K). To be noted, since the four image process cartridges PY, PM, PC, and PK are the same in a configuration except for a difference in a color of formed images, only the image forming process of the process cartridge PY will be described, and descriptions of the other process cartridges PM, PC, and PK will be omitted herein.

The laser scanners 13Y, 13M, 13C, and 13K irradiate a laser beam toward a photosensitive drum 11 of the process cartridge PY based on the input image information. At this time, the photosensitive drum 11 has been charged by a charge roller 12 beforehand, and an electrostatic latent image is formed on the photosensitive drum 11 by being irradiated with the laser beam. Thereafter, the electrostatic latent image is developed by a developing roller 14, and a toner image of yellow (Y) is formed on the photosensitive drum 11.

Similarly, toner images of magenta (M), cyan (C), and black (K) are respectively formed on the process cartridges PM, PC, and PK. The toner images of the respective colors formed on respective photosensitive drums are transferred to an intermediate transfer belt 21 by primary transfer rollers 25Y, 25M, 25C, and 25K, and are conveyed to a secondary transfer roller 43 by the intermediate transfer belt 21 that rotates in an arrow direction. The intermediate transfer belt 21 is wound around a drive roller 23, a tension roller 24, a secondary transfer inner roller 22, and the like. To be noted, the image forming process of each color is performed in a timing superimposing the toner image on an upstream toner image primarily transferred onto the intermediate transfer belt 21.

In parallel with the image forming process describe above, a sheet P stacked on the cassettes 31 and 32 is fed by the feed unit 40. The feed unit 40 includes a pickup roller 40*a*, a conveyance roller 40*b*, and a separation roller 40*c*, and the sheet P fed by the pickup roller 40*a* is conveyed after being separated into one sheet at a time by the conveyance roller 40*b* and the separation roller 40*c*.

The sheet P conveyed by the feed unit 40 is conveyed to a registration roller pair 42 by a preregistration roller pair 41. Further, it is acceptable to convey the sheet P stacked on the manual feed tray 33 to the registration roller pair 42. Then, the skew of the sheet P is corrected by the registration roller pair 42, and in accordance with a detection result of a registration sensor 44, the sheet P is conveyed to a secondary transfer nip N1 formed by the secondary transfer inner roller 22 and the secondary transfer roller 43 in a predetermined timing. The registration sensor 44 is disposed downstream of the preregistration roller pair 41 and upstream of the registration roller pair 42 in a sheet conveyance direction.

A full color toner image is transferred onto a first surface of the sheet P by a secondary transfer bias applied to the secondary transfer roller 43 at the secondary transfer nip N1, serving as a transfer portion. A residual toner remained on the intermediate transfer belt 21 is collected by a cleaning blade 26. The sheet P onto which the toner image has been transferred is provided with predetermined heat and pressure by the fixing unit 50, and the toner is melted and adhered (fixed). The fixing unit 50 includes a film 51 heated by a heater, not shown, and a press roller 52 coming into pressure contact with the film 51, and a fixing nip N2, serving as a fixing portion, is formed by the film 51 and the press roller 52. The sheet P passed through the fixing unit 50 is discharged to either the sheet discharge tray 80 or the sheet discharge tray 81, which are disposed vertically, by the discharge conveyance unit 60. To be noted, it is acceptable to apply a heating roller incorporating a heater to the fixing unit 50 instead of the film 51.

In a case of forming the image on both surfaces of the sheet P, the sheet P is conveyed to the duplex conveyance unit 70 by the discharge conveyance unit 60. The sheet P conveyed to the duplex conveyance unit 70 is conveyed to the secondary transfer nip N1 by the registration roller pair 42, and the toner image is formed on a second surface at the secondary transfer nip N1. Then, the toner image is fixed by the fixing unit 50, and the sheet P on whose first and second surfaces the images have been formed is discharged to either the sheet discharge tray 80 or the sheet discharge tray 81 by the discharge conveyance unit 60.

Discharge Conveyance Unit

Figure 2:
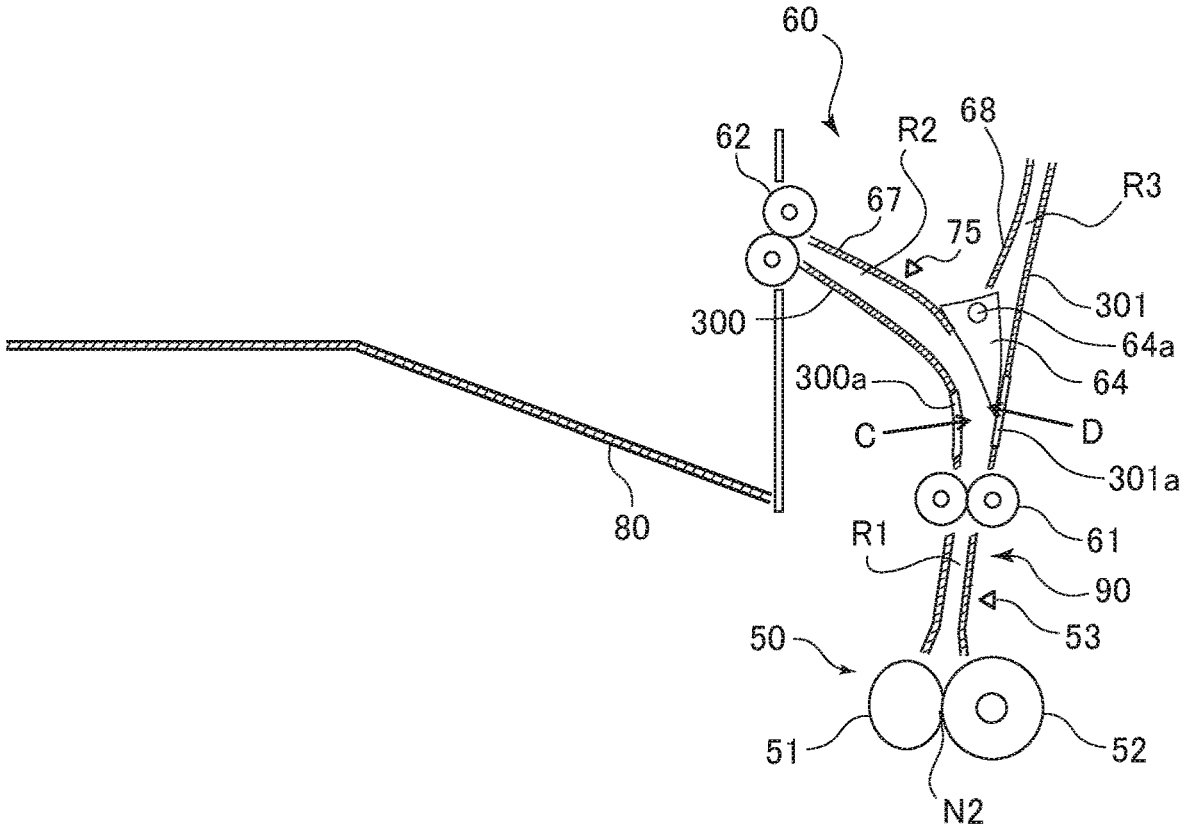
FIG. 2 is a cross-sectional view showing a discharge conveyance unit.

Next, using FIGS. 1 and 2, the discharge conveyance unit 60 will be described. As shown in FIGS. 1 and 2, the discharge conveyance unit 60 includes a conveyance roller pair 61, a guide member 64, sheet discharge roller pairs 62 and 71, a fixing sensor 53, and a discharge sensor 75. Further, a fixing conveyance path R1, and first and second discharge conveyance paths R2 and R3 branched from the fixing conveyance path R1 are disposed in the discharge conveyance unit 60.

The guide member 64 is pivotable around a pivot axis 64*a* as a center, and guides the sheet P passed through the fixing conveyance path R1 to the first discharge conveyance path R2 or the second discharge conveyance path R3. In a case of discharging the sheet P to the sheet discharge tray 80, the guide member 64 guides the sheet P to the first discharge conveyance path R2. Then, the sheet P is discharged to the sheet discharge tray 80 by the sheet discharge roller pair 62, serving as a sheet discharge unit.

In the case of forming the images on both surfaces (first and second surfaces) of the sheet P or in a case of discharging the sheet P to the sheet discharge tray 81, the guide member 64 guides the sheet P to the second discharge conveyance path R3. Then, the sheet P is discharged to the sheet discharge tray 81 by the sheet discharge roller pair 71, or conveyed to the duplex conveyance unit 70 after being switched back by the sheet discharge roller pair 71.

The fixing sensor 53 is disposed between the fixing nip N2 and the conveyance roller pair 61 in the sheet conveyance direction. The fixing sensor 53 detects the sheet P conveyed in the fixing conveyance path R1. For example, in a case where the sheet P is not detected by the fixing sensor 53 even after a predetermined detection timing has passed, the sheet P is judged to have wound around inside the fixing unit 50.

Further, the discharge sensor 75 is disposed between the guide member 64 and the sheet discharge roller pair 62 in the sheet conveyance direction. The discharge sensor 75 detects the sheet P conveyed in the first discharge conveyance path R2. For example, the guide member 64 is pivoted based on a timing in which a trailing edge of the sheet P conveyed in the first discharge conveyance path R2 is detected by the discharge sensor 75.

The fixing conveyance path R1 and the first and second discharge conveyance paths R2 and R3 are formed by conveyance guides 67, 68, 300, and 301. The conveyance guides 300 and 301 face each other in the part constructing the fixing conveyance path R1. The conveyance guides 67 and 300 face each other in a portion constructing the first discharge conveyance path R2. The conveyance guides 68 and 301 face each other in a portion constructing the second discharge conveyance path R3. To be noted, the fixing conveyance path R1 and the first and second discharge conveyance paths R2 and R3 construct a conveyance path 90.

An opening portion 300*a*, serving as a first air outlet port, having a slit shape is disposed on the conveyance guide 300, and an opening portion 301*a*, serving as a second air outlet port, having a slit shape is disposed on the conveyance guide 301. These opening portions 300*a* and 301*a* face each other, and the air C and air D sent from a fan 65 (refer to FIG. 3) respectively flow through the opening portions 300*a* and 301*a*.

Figure 3:
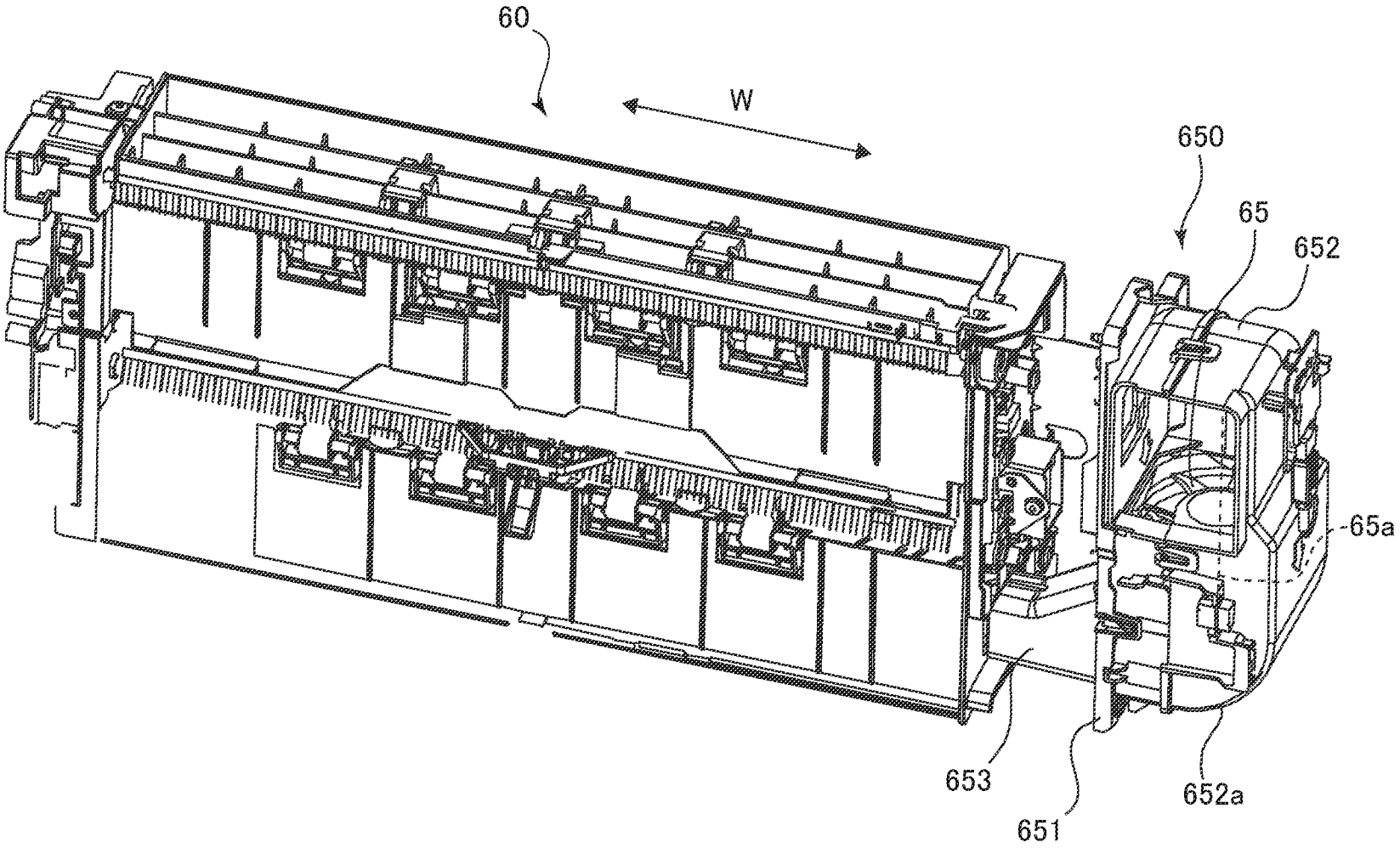
FIG. 3 is a perspective view showing a fan unit 650.
Figure 4A:
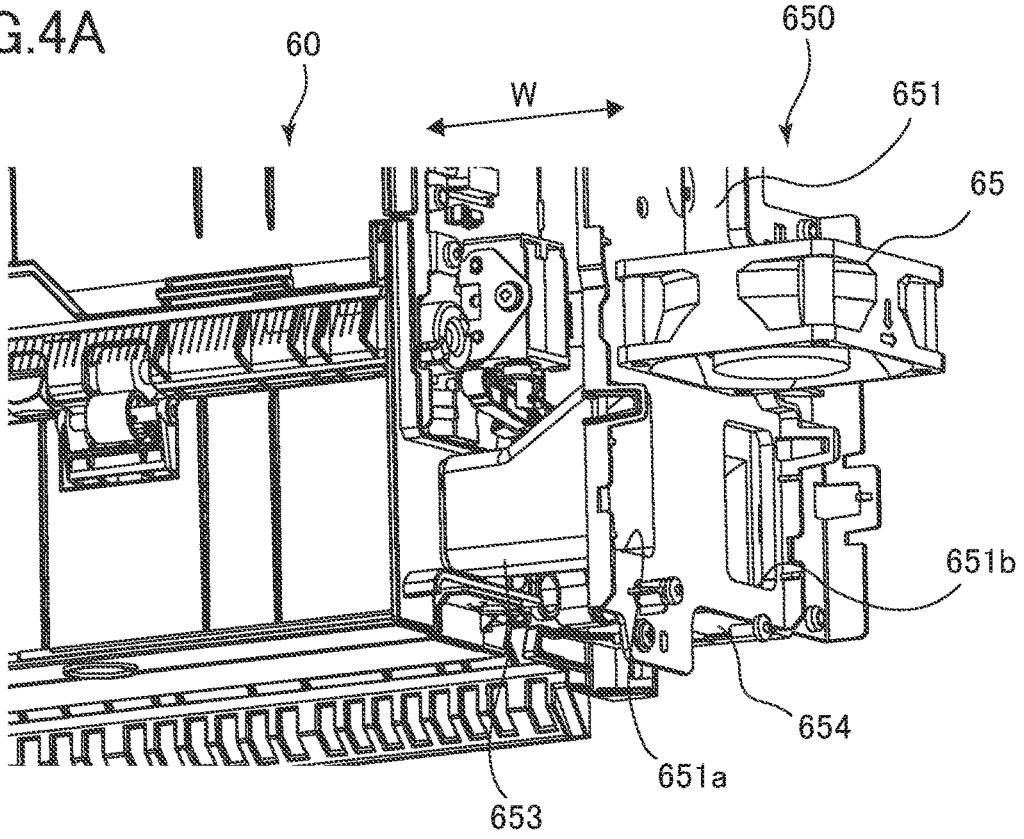
FIG. 4A is an enlarged perspective view showing the fan unit 650.
Figure 4B:
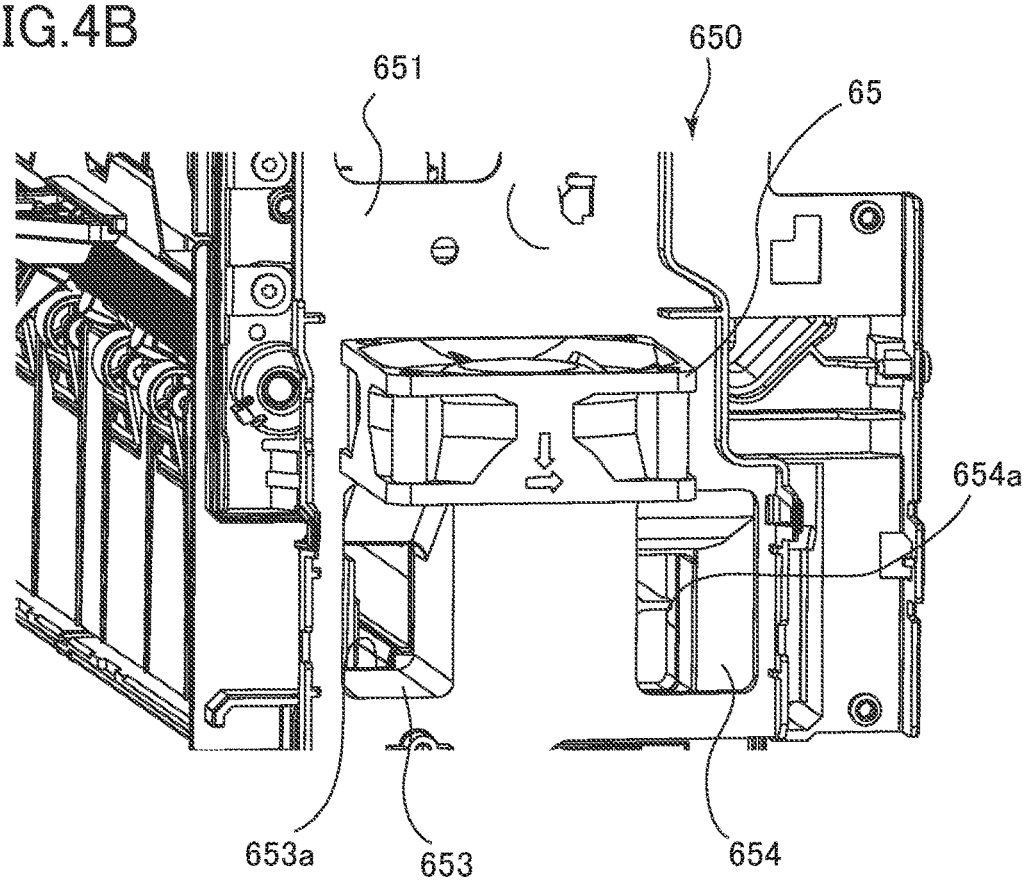
FIG. 4B is another perspective view showing the fan unit 650.

FIG. 3 is a perspective view showing a fan unit 650. FIG. 4A is an enlarged perspective view showing the fan unit 650. FIG. 4B is another enlarged perspective view showing the fan unit 650. To be noted, an illustration of a duct 654 is omitted in FIG. 3. As shown in FIGS. 3 to 4B, the fan unit 650 is disposed next to the discharge conveyance unit 60 in a width direction W orthogonally intersecting with the sheet conveyance direction. The fan unit 650 includes an intermediate plate 651, the fan 65, a fan cover 652, a duct 653, and the duct 654. The fan 65 and the fan cover 652 are both supported by the intermediate plate 651.

The fan 65 rotates around a shaft 65*a* extending approximately in the vertical direction as a center, and sends the air downward by sucking the outside air. The fan cover 652 includes a guide surface 652*a* disposed below the fan 65, and covers the fan 65. The intermediate plate 651 and the discharge conveyance unit 60 are coupled to each other by the ducts 653 and 654. Communication holes 651*a* and 651*b* are formed in the intermediate plate 651, and the communication holes 651*a* and 651*b* respectively communicate with the ducts 653 and 654.

The air sent downward by the fan 65 moves downward inside the fan cover 652, and, by being turned to a direction along the width direction W by the guide surface 652*a* of the fan cover 652, is guided to the communication holes 651*a* and 651*b*. The air passed through the communication hole 651*a* is sent as the air C to the conveyance path 90 through the duct 653 via a discharge hole 653*a* of the duct 653 and the opening portion 300*a* (refer to FIG. 2). Further, the air passed through the communication hole 651*b* is sent as the air D to the conveyance path 90 through the duct 654 via a discharge hole 654*a* of the duct 654 and the opening portion 301*a* (refer to FIG. 2). To be noted, it is acceptable to dispose the fan 65 in any place in the printer 1. Further, it is acceptable to directly send the air to the conveyance path 90 from the ducts 653 and 654. Further, while, in this embodiment, the fan 65 sends the air downward in the vertical direction, it is not limited to this. For example, it is acceptable that, by rotating the fan 65 around a shaft extending in the width direction W as a center, the fan 65 sends the air in the width direction W.

The air C is supplied to an image surface of the sheet P, namely a surface that comes into contact with the film 51, and plays a role of cooling the image surface which is in a high temperature state by the fixation of the toner image. Thereby, in a state where the sheet P is stacked on the sheet discharge tray 80, the adhesion of a discharged sheet by which the image surfaces of sheet bundles adhere to each other is prevented.

The air D is sent to the conveyance path 90 located downstream of the fixing unit 50, and plays a role of diffusing the air containing a water vapor discharged from the sheet P by the fixation of the toner image. Further, the air D is supplied to a non-image surface of the sheet P opposite to the image surface. Thereby, dew condensation caused by the adhesion of the water vapor in the conveyance path to a surface of the conveyance guide is suppressed.

Control Block

Figure 5:
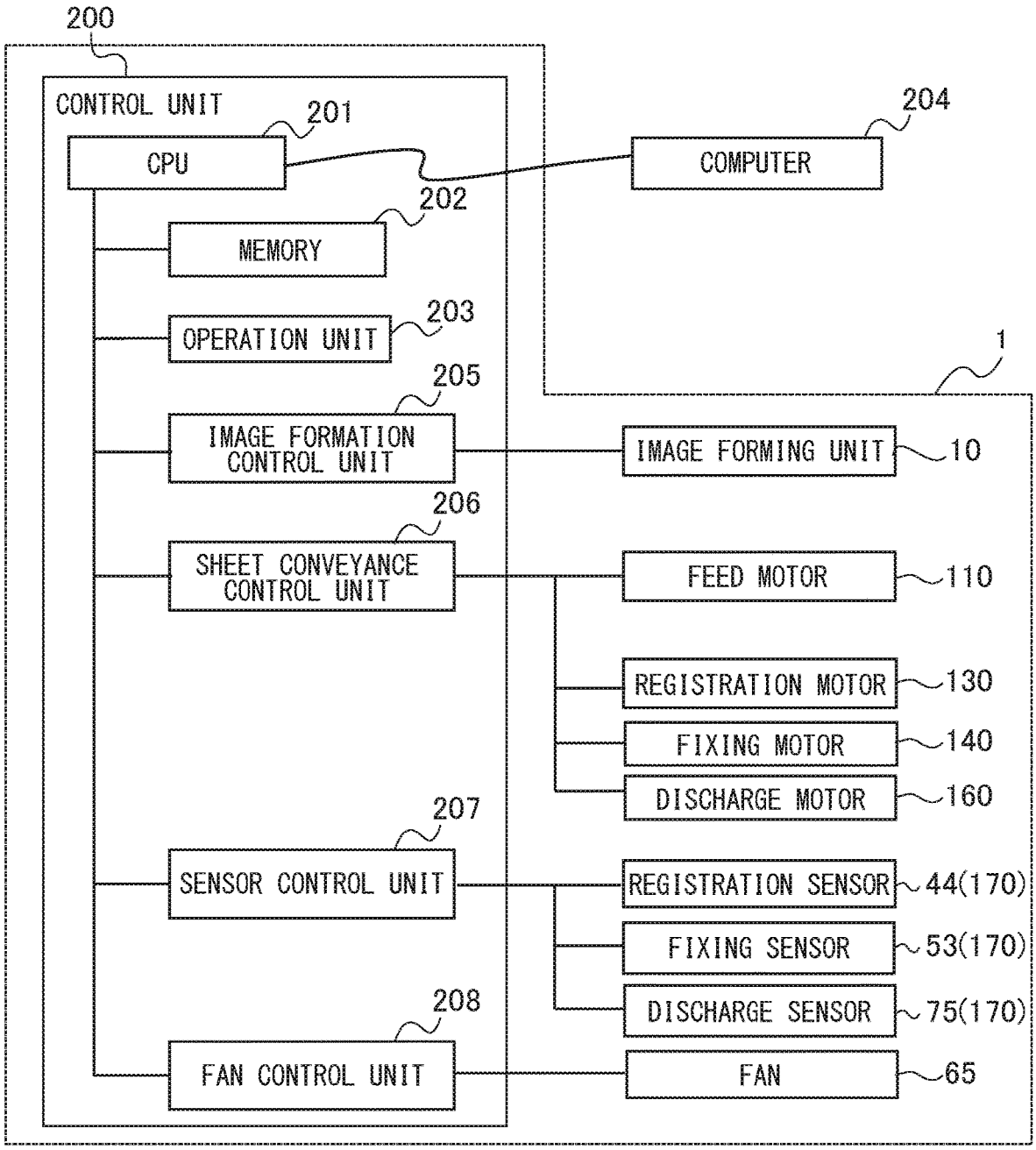
FIG. 5 is a block diagram showing a control block.

FIG. 5 is a block diagram showing a control block of the printer 1. As shown in FIG. 5, the printer 1 includes a control unit 200. The control unit 200 includes functional units, such as a central processing unit (CPU) 201, a memory 202, an operation unit 203, an image formation control unit 205, a sheet conveyance control unit 206, a sensor control unit 207, and a fan control unit 208. The memory 202 is constructed by a random-access memory (RAM), a read-only memory (ROM), and the like, and, along with storing various programs, used as a work area of the CPU 201.

The operation unit 203 accepts the various information relating to the sheet (for example, a size, grammage, surface property, and the like of the sheet) used for printing by a user and various operations performed by the user such as instructions on the execution and an interruption of the printing. The image formation control unit 205 outputs instructions to the image forming unit 10 including the laser scanners 13Y, 13M, 13C, and 13K, and controls image formation.

The sheet conveyance control unit 206 outputs instructions to a feed motor 110 driving the various conveyance rollers of the feed unit 40, a registration motor 130, a fixing motor 140, a discharge motor 160 driving the sheet discharge roller pairs 62 and 71, and the like, and controls the conveyance of the sheet P. The registration motor 130 drives the registration roller pair 42, and the fixing motor 140 drives the press roller 52 of the fixing unit 50.

The sensor control unit 207 controls a start or stop of the detection of the registration sensor 44, the fixing sensor 53, and the discharge sensor 75, and receives detection results from these respective sensors. To be noted, the registration sensor 44, the fixing sensor 53, and the discharge sensor 75 construct a detection unit 170 detecting a position of the sheet. The fan control unit 208 controls a drive, stop, and speed change of the fan 65. To be noted, it is acceptable that the control unit 200 receives information related to a sheet used for printing from a computer, for example the computer 204 illustrated in FIG. 5, connected with the control unit 200 via a network.

Drive Control of Fan

Next, a drive control of the fan 65 will be described. The control unit 200 (fan control unit 208) includes first and second modes for controlling the drive of the fan 65. As shown in FIG. 6, the first mode is performed in a case where a simplex printing job is performed with respect to the sheet having the grammage of equal to or more than 106 g/m$^2$. The simplex printing job is a job in which the image is formed only on one side of the sheet.

On the other hand, the second mode is performed in cases other than the first case, and is performed in a case where the simplex printing job is performed with respect to the sheet having the grammage of less than 106 g/m$^2$ or in a case where, regardless of the grammage, a duplex printing job is performed. The duplex printing job is a job in which the image is formed on both sides of the sheet.

Figure 7:
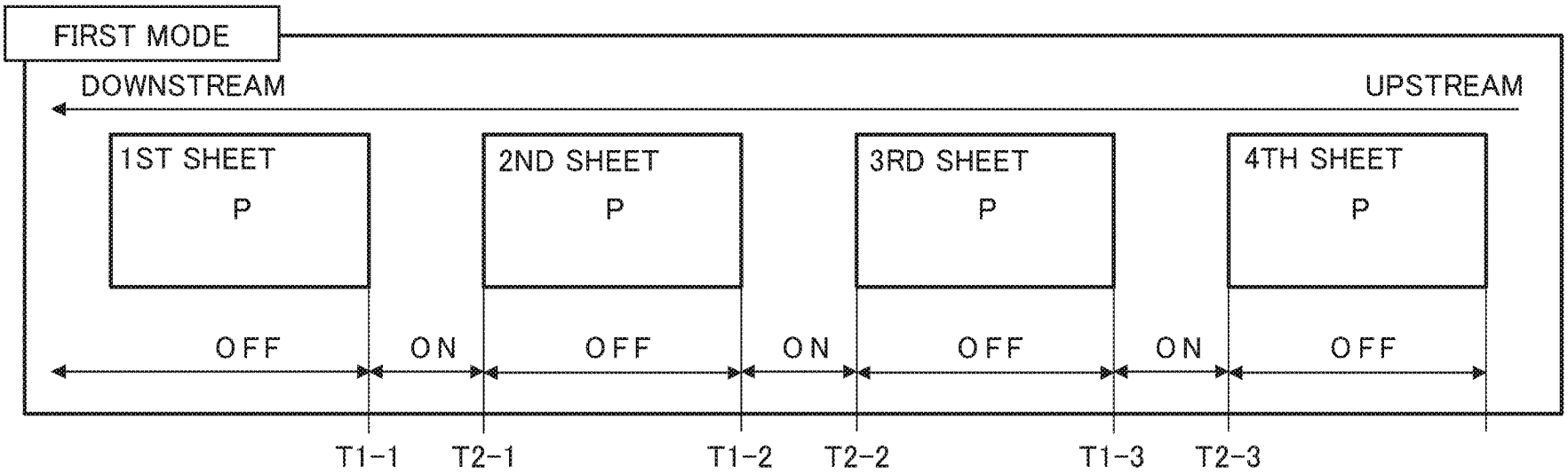
FIG. 7 is a diagram schematically showing a drive control of the fan in a first mode.
Figure 8:
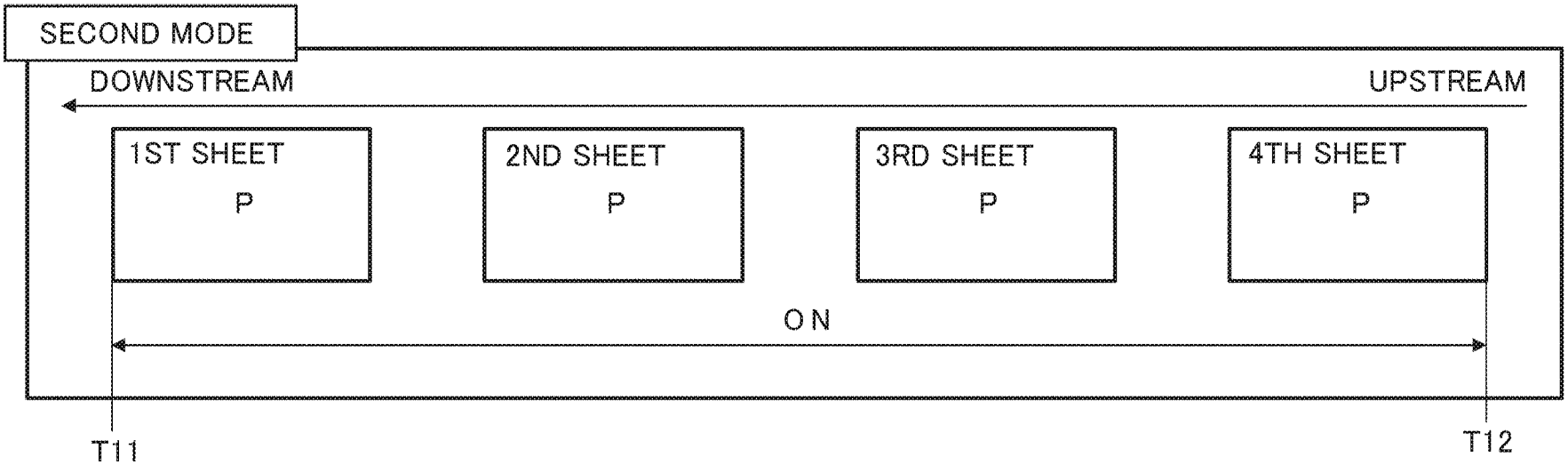
FIG. 8 is a diagram schematically showing a drive control of the fan in a second mode.

FIGS. 7 and 8 are a schematic diagrams respectively showing the drive controls of the fan 65 in the first mode and the second mode. To be noted, while a job for forming the image on four sheets of the sheet is taken as an example in FIGS. 7 and 8, it is not limited to this. That is, the first and second modes are not limited in terms of a number of printed sheets in the job, and, in the second mode, it is acceptable that the sheets for forming the image on a first surface and a second surface are mixed in a sequence of the conveyance.

Second Mode

As shown in FIG. 8, in the second mode, the control unit 200 drives the fan 65 when a leading edge of the first sheet reaches the opening portion 300*a* at the time T11. Then, the control unit 200 maintains the drive of the fan 65 until a trailing edge of the fourth sheet has passed through the opening portion 300*a*. The control unit 200 stops the drive of the fan 65 when the trailing edge of the fourth sheet has passed through the opening portion 300*a* at the time T12. That is, the control unit 200 drives the fan 65 from the time when the first sheet of the job has reached a position facing the opening portion 300*a* until the time when the last sheet of the job has passed through the opening portion 300*a*.

First Mode

Next, the first mode will be described in detail. As shown in FIG. 7, in the first mode, after a start of the job, the control unit 200 holds the fan 65 in an OFF state, namely in a state of stopping the drive of the fan 65. Then, the control unit 200 turns ON the drive of the fan 65, namely drives the fan 65 when a trailing edge of the first sheet has passed through or by the opening portion 300*a* at the time T1-1.

Next, the control unit 200 turns OFF the fan 65 when a leading edge of the second sheet has reached the opening portion 300*a* at the time T2-1. The time T1-2 and T1-3 are respectively timings in which trailing edges of the second and third sheets have passed through the opening portion 300*a*. The control unit 200 turns ON the drive of the fan 65 at the time T1-2 and T1-3, similar to the time T1-1.

Further, the time T2-2 and T2-3 are respectively timings in which leading edges of the third and fourth sheets reach the opening portion 300*a*. The control unit 200 turns OFF the drive of the fan 65 at the time T2-2 and T2-3, similar to the time T2-1. That is, in the first mode, the control unit 200 drives the fan 65 when the sheet is not present in a position facing the opening portion 300*a*, and stops the drive of the fan 65 when the sheet is present in the position facing the opening portion 300*a*.

In this embodiment, the time T1-1, T1-2, and T1-3 are determined from a conveyance speed and conveyance distance of the sheet P based on the information obtained by the detection of the sheet P by the discharge sensor 75. Further, the time T2-1, T2-2, and T2-3 are determined from a conveyance speed and conveyance distance of the sheet P based on the information obtained by the detection of the sheet P by the registration sensor 44.

To be noted, it is acceptable to determine the time T1-1, T1-2, T1-3, T2-1, T2-2, and T2-3 based on the information obtained by the detection of the sheet P by the other sensors or based on a fed timing of the sheet P. For example, it is acceptable to determine the time T1-1, T1-2, and T1-3 based on a detection result of the registration sensor 44, and acceptable to determine the time T2-1, T2-2, and T2-3 based on a detection result of the fixing sensor 53.

Figure 9:
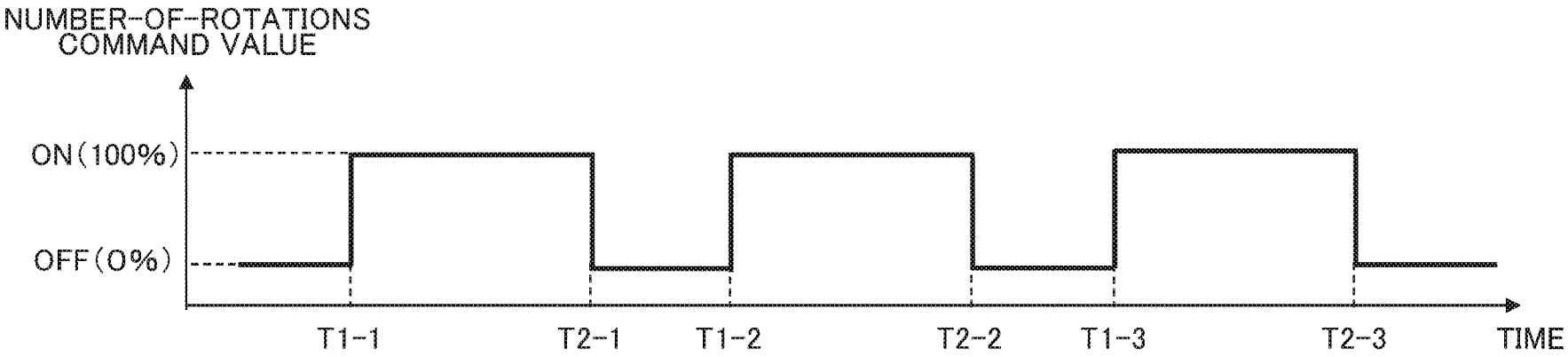
FIG. 9 is a timing chart showing a number-of-rotations command value of the fan in the first mode.

FIG. 9 is a timing chart showing a number-of-rotations command value of the fan 65 in the first mode in this embodiment. In the first mode, the fan control unit 208 of the control unit 200 does not output a command for driving the fan 65 until the time T1-1, and outputs a number-of-rotations command so as to turn ON (bring into a drive state) the fan 65. Then, as described above, the fan control unit 208 turns OFF the drive of the fan 65 at the time T2-1, T2-2, and T2-3. Further, the fan control unit 208 turns ON the drive of the fan 65 at the time T1-2 and T1-3, similar to the time T1-1.

In this embodiment, a number-of-rotations command value output to the fan 65 at the time T1-1, T1-2, and T1-3 is 100%, and a number-of-rotations command value output to the fan 65 at the time T2-1, T2-2, and T2-3 is 0%. That is, the fan 65 is switched between two patterns called ON and OFF. To be noted, it is acceptable to use either an alternating current (AC) motor or a direct current (DC) motor for the drive motor driving the fan 65, and possible to choose any drive system for the drive motor. The number-of-rotations command value output from the fan control unit 208 is, for example, converted into a voltage or a control signal, and input to the fan 65.

Effect of this Embodiment

FIG. 10 is a table showing effects on dew condensation, the adhesion of a discharged sheet, and a curl in a case where the fan 65 is continuously turned ON (namely, the second mode) during the execution of the job and in a case where the fan 65 is turned OFF in portions encircled by a dashed line.

The dew condensation is caused by the adhesion of the moisture vaporized from the sheet by the fixing unit 50 to the conveyance guide. Then, in a case where the moisture adheres to a succeeding sheet, a problem of wrinkling of the sheet or image defects occurs. Further, the adhesion of the discharged sheet is caused by stacking the sheet on the sheet discharge trays 80 and 81 while in a state of a high temperature, so that the toners on the sheets opposite each other adhere to each other.

It is possible to reduce the dew condensation by sending the air downstream of the fixing unit 50 in the sheet conveyance direction, and, especially, possible to improve the effect by applying the air onto a non-image surface side of the sheet. This is because, since an image surface of the sheet is covered by the toner, more water vapor evaporates from the non-image surface side of the sheet. It is possible to reduce the adhesion of the discharged sheet by applying the air onto the sheet, and, especially, possible to improve the effect by applying the air onto an image surface side of the sheet. This is because the heat provided to the image surface side of the sheet from the fixing unit 50 is more than the heat provided to the non-image surface side.

The curl occurs due to a difference in a degree of a contraction between both sides of the sheet P. While, by receiving the heat from the film 51, the sheet P tries to evaporate inside moisture, since the toner covers the sheet surface on the image surface side, an evaporation amount is little. On the other hand, since the moisture moves from the image surface side, the evaporation amount on the non-image surface side becomes large. Therefore, the curls occurs in such a manner that the non-image surface side of the sheet becomes the inside of curvature.

In a case where the air is applied to the image surface side, since the evaporation amount on the image surface side is further decreased, a curl amount is increased. At this point, in a case where a plurality of fans for sending the air are disposed so as to individually cool the image and non-image surface sides of the sheet, it is possible to cope with the curl, but the size and cost of the apparatus are increased.

In this embodiment, if the fan 65 is continuously turned ON, as shown in FIG. 10, there is a problem of the curl in the simplex printing job using the sheet with the grammage of equal to or more than 106 g/m$^2$. To be noted, in the duplex printing job, since the difference in the degree of the contraction between both sides of the sheet P has been reset by twice passing through the fixing unit 50, an evaluation of the curl is satisfactory. Further, since a stiffness of the sheet with the grammage of less than 106 g/m$^2$ is low in comparison with the sheet having the grammage of equal to or more than 106 g/m$^2$, the curl is corrected by yielding to a force by own weight at a time of being discharged to the sheet discharge trays 80 and 81. Therefore, the evaluation of the curl of the sheet having the grammage of less than 106 g/m$^2$ is also satisfactory.

On the other hand, in a case where the fan 65 is continuously turned OFF during the execution of the job, there is a problem of the dew condensation in the simplex printing job using the sheet with the grammage of equal to or more than 106 g/m$^2$. That is, the curl and the dew condensation are in a trade-off relationship.

However, in this embodiment, the control unit 200 performs the first mode described above in the simplex printing job using the sheet with the grammage of equal to or more than 106 g/m$^2$. That is, it is possible to reduce the curl and the dew condensation by turning ON the fan 65 in the timing in which the sheet P is not present in the position facing the opening portion 300*a*. To be noted, since there is a possibility that, depending on fixing temperature conditions, a curl amount is increased not only in a case of the sheet with the grammage of equal to or more than 106 g/m$^2$ but also in a case of recycled paper or the like, not only the grammage but also a type of media may become one of selection criteria of the control mode of the fan 65.

Incidentally, why an evaluation of the adhesion of the discharge sheet is satisfactory even in a case where the fan 65 is continuously turned OFF is due to the following two reasons. The first reason is that, in a state where a plurality of sheets are stacked on the sheet discharge trays 80 and 81, a case where the toner is fixed on one side of the sheet is more advantageous than a state where the toner is fixed on both sides of the sheet.

A relationship between productivity and the grammage is related to the second reason. While, in a viewpoint of fixability, it is necessary to increase the temperature higher the larger the grammage becomes, there is a line for performance reasons of the fixing unit 50, and it is not possible to increase the temperature higher than a temperature which surpasses the line. Therefore, it is a common practice that the fixation of the sheet having the grammage of equal to or more than a predetermined value is performed by decreasing the conveyance speed and thereby increasing the heat supplied per unit time and unit area.

In this embodiment, since the conveyance speed is decreased in the case where the grammage of the sheet is equal to or more than 106 g/m$^2$, in a job of printing the plurality of sheets, the duration of the time between the sheets is lengthened, and cooling of the sheet discharged on the sheet discharge trays 80 and 81 becomes easier. Since, because of the two reasons described above, media with the grammage of equal to or more than the predetermined grammage and the simplex printing job are substantially advantageous with respect to the adhesion of the discharged sheet, it is not necessary to apply the air C.

As described above, in this embodiment, the first mode is performed in the simplex printing job using the sheet with the grammage of equal to or more than 106 g/m$^2$, and the second mode is performed in the other conditions. Thereby, an occurrence of the dew condensation, the adhesion of the discharged sheet, and the curl are reduced, and the quality of the deliverables is improved. Further, since, without disposing two fans for sending the air individually to each of the opening portions 300*a* and 301*a*, a single fan 65 is disposed, it is possible to reduce the cost.

Other Embodiments

To be noted, while, in the embodiments described above, the fan 65 is driven in a case where the sheet P is not present in the position facing the opening portion 300*a* and the drive of the fan 65 is stopped in a case where the sheet P is present in the position facing the opening portion 300*a*, it is not limited to this. For example, it is known by inspection that it is possible to obtain the effects described above even if the position of the sheet P is shifted back and forth by a few millimeter (mm) at the time T1-1, T1-2, T2-1, T2-1, T2-2, and T2-3.

Further, it is acceptable that the fan 65 is driven in a case where a printing area of the sheet P is not present in the position facing the opening portion 300*a* and the drive of the fan 65 is stopped in a case where the printing area of the sheet P is present in the position facing the opening portion 300*a*. That is, the control unit 200 stops the drive of the fan 65 when a leading edge of the printing area of the sheet P has reached the opening portion 300*a*. Further, the control unit 200 drives the fan 65 when a trailing edge of the printing area of the sheet P has passed through the opening portion 300*a*. Since, in these cases, the fan 65 is driven even if a blank space of the sheet P is present in the position facing the opening portion 300*a*, it is further advantageous with respect to the dew condensation. For example, in the image forming apparatus that provides high productivity, in a case where the fan 65 is driven only during a sheet gap between a preceding sheet and a succeeding sheet, concern about the dew condensation sometimes remains. Therefore, by driving the fan 65 even in a case where the blank space of the sheet P is present in the position facing the opening portion 300*a*, it is possible to provide the high quality deliverables even in the case of the image forming apparatus having the high productivity.

Further, while, in the embodiments described above, the drive of the fan 65 is turned OFF at the time T2-1, T2-2, and T2-3, it is not limited to this. For example, it is acceptable to set the number-of-rotations command value at the time T2-1, T2-2, and T2-3 at more than zero and less than 100%, preferably at 50%. A required curl amount varies according to a specification of respective products, and a threshold value of an air volume so as to acquire the specified curl amount depends on a fixing configuration of the respective image forming apparatuses.

That is, in the first mode, the control unit 200 controls the fan 65 such that a rotational speed of the fan 65 becomes a first rotational speed in a case where the sheet P is not present in the position facing the opening portion 300*a* and becomes a second rotational speed in a case where the sheet P is present in the position facing the opening portion 300*a*. Further, in the first mode, the control unit 200 controls the fan 65 such that a rotational speed of the fan 65 becomes the first rotational speed in a case where the printing area of the sheet P is not present in the position facing the opening portion 300*a* and becomes the second speed in a case where the printing area of the sheet P is present in the position facing the opening portion 300*a*. The second rotational speed is a speed lower than the first rotational speed, and includes zero.

Further, it is not necessary to drive the fan 65 only at the first and second rotational speeds. For example, it is acceptable to set an average rotational speed of the fan 65 at the first rotational speed in a period of the time when the sheet P is not present in the position facing the opening portion 300*a* and set an average rotational speed of the fan 65 at the second rotational speed in a period of the time when the sheet P is present in the position facing the opening portion 300*a*.

Further, while, in the embodiments described above, the control unit 200 performs the first mode in the simplex printing job using the sheet with the grammage of equal to or more than 106 g/m$^2$ and performs the second mode in the other conditions, it is not limited to this. For example, it is acceptable to appropriately set the grammage, not limited to equal to or more than 106 g/m$^2$, of the sheet for performing the first mode depending on a specification of the printer 1. That is, the control unit 200 chooses either the first mode or the second mode in accordance with at least one of a type of the sheet P that is conveyed, the grammage of the sheet P that is conveyed, and a type of the job.

Further, while, in the embodiments described above, in the second mode, the fan 65 is continuously driven from the time when the first sheet of the job has reached the opening portion 300*a* until the time when the last sheet of the job has passed through the opening portion 300*a*, it is not limited to this. For example, as long as the dew condensation is not affected, it is acceptable to stop the drive of the fan 65 when the sheet P is not present in the position facing the opening portion 300*a*. Further, it is acceptable to drive the fan 65 in any timing from a start of the feed of the first sheet of the job until the arrival of the first sheet at the opening portion 300*a*.

Further, while, in the embodiments described above, the opening portions 300*a* and 301*a* face each other, it is not limited to this. For example, it is acceptable to dispose the opening portion 301*a* downstream of the opening portion 300*a* in the sheet conveyance direction so that the opening portions 300*a* and 301*a* do not face each other.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-062670, filed Apr. 1, 2021, which is hereby incorporated by reference herein in its entirety.

What is claimed is:

1. An image forming apparatus comprising:

a transfer unit configured to transfer a toner image onto a sheet;

a fixing unit configured to fix the toner image transferred by the transfer unit on the sheet;

a discharge unit configured to discharge the sheet on which the toner image has been fixed;

a conveyance path through which the sheet conveyed from the fixing unit to the discharge unit passes;

a single fan configured to rotate so as to send air;

a first air outlet port disposed on the conveyance path, and disposed so as to supply the air sent from the fan to an image surface of the sheet passing through the conveyance path, the image surface being a surface on which the toner image has been fixed;

a second air outlet port disposed on the conveyance path, and disposed so as to supply the air sent from the fan to a surface opposite to the image surface of the sheet passing through the conveyance path; and a control unit configured to control the fan, wherein the control unit includes a first mode of controlling a rotational speed of the fan at a first rotational speed in a case where the sheet is not present in a position facing the first air outlet port and control the rotational speed of the fan at a second rotational speed lower than the first rotational speed in a case where the sheet is present in the position facing the first air outlet port.

2. The image forming apparatus according to claim 1, wherein the control unit stops a drive of the fan in the first mode in case where the sheet is present in the position facing the first air outlet port.

3. The image forming apparatus according to claim 1, wherein, in the first mode, the control unit stops a drive of the fan in a case where a leading edge of the sheet has reached the first air outlet port, and drives the fan in a case where a trailing edge of the sheet has passed by the first air outlet port.

4. The image forming apparatus according to claim 1, wherein the first air outlet port and the second air outlet port are disposed so as to face each other.

5. The image forming apparatus according to claim 1, further comprising a detection unit configured to detect a position of the sheet.

6. The image forming apparatus according to claim 1, wherein the control unit includes a second mode of driving the fan from a time when a first sheet of a job has reached the first air outlet port until a time when a last sheet of the job passes by the first air outlet port.

7. The image forming apparatus according to claim 6, wherein the control unit chooses either the first mode or the second mode in accordance with at least one of a type of the sheet, a grammage of the sheet, and a type of a job.

8. The image forming apparatus according to claim 1, wherein the control unit performs the first mode in a job in which the image is formed only on one side of a sheet having at least a predetermined grammage.

9. The image forming apparatus according to claim 8, wherein the control unit includes a second mode of driving the fan from a time when a first sheet of a job has reached the first air outlet port until when a last sheet of the job passes by the first air outlet port, and wherein, regardless of a grammage of the sheet, the control unit performs the second mode in a job in which the image is formed on both sides of the sheet.

10. An image forming apparatus comprising:

a transfer unit configured to transfer a toner image onto a sheet;

a fixing unit configured to fix the toner image transferred by the transfer unit on the sheet;

a discharge unit configured to discharge the sheet on which the toner image has been fixed;

a conveyance path through which the sheet conveyed from the fixing unit to the discharge unit passes;

a single fan configured to rotate so as to send air;

a first air outlet port disposed on the conveyance path, and disposed so as to supply the air sent from the fan to an image surface of the sheet passing through the conveyance path, the image surface being a surface on which the toner image has been fixed;

a second air outlet port disposed on the conveyance path, and disposed so as to supply the air sent from the fan to a surface opposite to the image surface of the sheet passing through the conveyance path; and a control unit configured to control the fan, wherein the control unit includes a first mode of controlling a rotational speed of the fan at a first rotational speed in a case where a printing area of the sheet is not present in a position facing the first air outlet port and controlling the rotational speed of the fan at a second rotational speed lower than the first rotational speed in a case where the printing area of the sheet is present in the position facing the first air outlet port.

11. The image forming apparatus according to claim 10, wherein the control unit stops a drive of the fan in the first mode in the case where the printing area of the sheet is present in the position facing the first air outlet port.

12. The image forming apparatus according to claim 10, wherein, in the first mode, the control unit stops a drive of the fan in a case where a leading edge of the printing area of the sheet has reached the first air outlet port, and drives the fan in a case where a trailing edge of the printing area of the sheet has passed by the first air outlet port.

13. The image forming apparatus according to claim 10, wherein the first air outlet port and the second air outlet port are disposed so as to face each other.

14. The image forming apparatus according to claim 10, further comprising a detection unit configured to detect a position of the sheet.

15. The image forming apparatus according to claim 10, wherein the control unit includes a second mode of driving the fan from a time when a first sheet of a job has reached the first air outlet port until a time when a last sheet of the job passes by the first air outlet port.

16. The image forming apparatus according to claim 15, wherein the control unit chooses either the first mode or the second mode in accordance with at least one of a type of the sheet, a grammage of the sheet, and a type of a job.

17. The image forming apparatus according to claim 10, wherein the control unit performs the first mode in a job in which the image is formed only on one side of a sheet having at least a predetermined grammage.

18. The image forming apparatus according to claim 17, wherein the control unit includes a second mode of driving the fan from a time when a first sheet of a job has reached the first air outlet port until a time when a last sheet of the job passes by the first air outlet port, and wherein, regardless of a grammage of the sheet, the control unit performs the second mode in a job in which the image is formed on both sides of the sheet.

* * * * *